US007798289B2

(12) United States Patent
Wieg et al.

(10) Patent No.: US 7,798,289 B2
(45) Date of Patent: Sep. 21, 2010

(54) INTERNAL-COMBUSTION ENGINE HAVING A PRESSURE LUBRICATION SYSTEM ACCORDING TO THE DRY-SUMP PRINCIPLE

(75) Inventors: Thorsten Wieg, Pforzheim (DE); Erwin Rutschmann, Tiefenbronn (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 847 days.

(21) Appl. No.: 10/592,873

(22) PCT Filed: Apr. 15, 2005

(86) PCT No.: PCT/EP2005/003986

§ 371 (c)(1),
(2), (4) Date: Sep. 14, 2006

(87) PCT Pub. No.: WO2006/000268

PCT Pub. Date: Jan. 5, 2006

(65) Prior Publication Data

US 2008/0236950 A1 Oct. 2, 2008

(30) Foreign Application Priority Data

Jun. 23, 2004 (DE) ..... 10 2004 030 352

(51) Int. Cl.
*F01M 1/04* (2006.01)

(52) U.S. Cl. ..... 184/6.5; 184/1.5; 184/6.13; 184/6.8; 184/6.22; 184/106; 123/41.42; 123/41.72; 123/196 R; 123/196 M; 123/196 S

(58) Field of Classification Search ..... 184/6.13, 184/6.8, 6.5; 123/41.28, 41.29, 41.81, 195 R, 123/195 S
See application file for complete search history.

(56) References Cited

U.S. PATENT DOCUMENTS 2,073,096 A * 3/1937 Church ..... 184/6.21
2,079,357 A * 5/1937 Morris et al. ..... 92/147

(Continued)

FOREIGN PATENT DOCUMENTS

DE 3639691 6/1988

(Continued)

OTHER PUBLICATIONS

International Search Report dated Nov. 16, 2005 with an English translations of the pertinent portions (Ten (10) pages).

(Continued)

*Primary Examiner*—Robert A Siconolfi
*Assistant Examiner*—San Aung
(74) *Attorney, Agent, or Firm*—RatnerPrestia

(57) ABSTRACT

An internal-combustion engine having a pressure lubrication system according to the dry-sump principle, particularly for an opposed-cylinder engine, having a crankcase in which an oil scavenging space is constructed in the lower part feeds the lubricating oil by way of an oil return feed pump equipped with an oil scavenging pipe to an oil storage tank. The lubricating oil situated in the oil storage tank is fed by way of a main feed pump to the consuming devices. The oil storage space forming the wet sump is also integrated in the crankcase of the internal-combustion engine.

7 Claims, 4 Drawing Sheets

U.S. PATENT DOCUMENTS

| | | | | |
|---|---|---|---|---|
| 2,443,875 | A | 6/1948 | Spangenberger | |
| 2,575,315 | A | 11/1951 | Edwards | |
| 2,974,652 | A | 3/1961 | Benzinger | |
| 4,440,117 | A | 4/1984 | Buchmüller | |
| 4,674,457 | A | 6/1987 | Berger et al. | |
| 4,813,408 | A | 3/1989 | Katsumoto et al. | |
| 4,815,419 | A * | 3/1989 | Kitada et al. | 123/41.42 |
| 4,825,824 | A | 5/1989 | Chino et al. | |
| 4,834,030 | A | 5/1989 | Bauer et al. | |
| 4,915,070 | A | 4/1990 | Okui | |
| 5,215,316 | A | 6/1993 | Udagawa | |
| 5,333,575 | A * | 8/1994 | Olmr | 123/41.42 |
| 5,572,968 | A * | 11/1996 | Esch et al. | 123/196 M |
| 5,842,447 | A | 12/1998 | Krotky et al. | |
| 6,142,129 | A | 11/2000 | Hori et al. | |
| 6,578,541 | B2 | 6/2003 | Stromsky et al. | |
| 6,823,968 | B2 * | 11/2004 | Baeumler | 184/106 |
| 7,240,657 | B2 | 7/2007 | Watanabe | |
| 2003/0042078 | A1 | 3/2003 | Baeumler | |
| 2003/0140888 | A1 * | 7/2003 | Tanaka et al. | 123/196 R |
| 2004/0031636 | A1 | 2/2004 | Pichler et al. | |

FOREIGN PATENT DOCUMENTS

| | | |
|---|---|---|
| DE | 19837099 | 10/1999 |
| DE | 100 14 368 A1 | 10/2001 |
| DE | 100 29 844 A1 | 1/2002 |
| DE | 10053096 | 5/2002 |
| DE | 101 39 709 A1 | 2/2003 |
| EP | 0 335 246 A2 | 10/1989 |
| EP | 1079080 | 2/2001 |

OTHER PUBLICATIONS

German Office Action dated Apr. 11, 2005 (Five (5) pages).
PCT International Search Report dated Oct. 19, 2005, application No. PCT/EP2005/003992.
German Office Action dated Apr. 22, 2005 with English translation, application No. 10-2004030353.3-13.

* cited by examiner

INTERNAL-COMBUSTION ENGINE HAVING A PRESSURE LUBRICATION SYSTEM ACCORDING TO THE DRY-SUMP PRINCIPLE

This application is a National Phase of PCT/EP2005/003986, filed Apr. 15, 2005, and claims the priority of DE 10 2004 030 352.5, filed Jun. 23, 2004, the disclosures of which are expressly incorporated by reference herein.

BACKGROUND AND SUMMARY OF THE INVENTION

The present invention relates to an internal-combustion engine having a pressure lubrication system according to the dry-sump principle, particularly for an opposed-cylinder engine.

In today's water-cooled 6-cylinder horizontally opposed engines of the Porsche 911 Carrera series, an oil partition box is provided in the oil bearing housing or in the oil pan and is fastened to the oil pan lid. The oil sump for the lubricating oil supply of the engine is constructed in this oil partition box. The lubricating oil returned from the consuming devices into the oil pan is first returned outside the oil partition box forming the oil scavenging space before it flows into the actual oil scavenging space via openings monitored in the oil partition box by flaps.

In engines with a dry-sump lubrication, the oil flowing back into the oil pan is delivered by a scavenging pump into a separate oil tank or oil storage tank. The pressure oil feed pump removes the lubricant from there by suction and presses it by way of filters and, if required, oil coolers to the lubricating points. In most cases, the oil tank is fastened on the outside to the crankcase and has corresponding connections for the externally laid pressure oil pipes.

An object of the present invention is to provide a low-friction driving mechanism with a dry-sump pressure lubrication system, particularly for the high rotational speed operation, in which the return or circulation times for lubricating oil are shortened, for increasing the specific power of an internal-combustion engine. In addition, the components required for the pressure lubrication system of the internal-combustion engine are to be largely integrated in the engine in a space-saving manner.

According to the invention, this object is achieved by integrating the dry and wet sump space in the internal-combustion engine crankcase. As a result, the oil tank or oil storage tank required for the dry-sump lubrication can be integrated in a space-saving manner directly in the engine, so that the otherwise normally required externally laid oil pipes are largely eliminated. The circulating paths and therefore the circulating times for the lubricating oil are therefore shortened so that, even at high lateral or longitudinal accelerations of the vehicle, a sufficient lubricating oil supply is ensured.

In a first advantageous embodiment, the oil storage space forming the wet sump is arranged directly below the dry-sump space. For this purpose, for example, the oil lid closing off the dry sump space in the downward direction has a double-walled construction. An oil scavenging snorkel leading to the main oil pump of the engine is placed at the floor of the forming hollow space. Furthermore, the hollow space receiving the lubricating oil is equipped with a connection which is connected with the delivery side of the dry-sump oil return pump.

In a second advantageous embodiment, the oil storage space forming the wet sump is integrated directly in the crankcase and is separated from the dry-sump space by one or more partitioning walls. This offers a solution, for example, for an opposed-cylinder engine, because of the horizontally arranged cylinder for the oil return into the wet sump. In this solution, an oil partition box forming the dry space is arranged in the crankcase such that (wet sump) collecting spaces for the lubricating oil removed by suction from the oil partition box remain on the left and the right of the oil partition box. The two collecting spaces are connected with one another by a space between the oil pan lid and the floor of the oil partition box.

For the defoaming or venting of the lubricating oil, the lubricating oil removed by suction from the dry-sump space and the cylinder heads is delivered into the wet sump by a central oil/air separator.

Another aspect of the invention consists of the fact that annular spaces around the cylinders are utilized for returning the oil into the wet sump collecting spaces. Particularly in the case of cylinder crankcases of an open-deck construction, where the water cooling jacket is formed only in the upper portion of the cylinders, an annular space remains which is open toward the crankcase space and which, with a corresponding face-side sealing, can be utilized as part of the oil return pipe into the wet sump. Since the wet-sump collecting space(s) are arranged below the annular spaces utilized for the oil return, by way of corresponding openings, the lubricating oil can flow from the annular spaces directly into the collecting space(s). This largely eliminates external oil pipes, so that this measure contributes to a compact and cost-effective conversion of an internal-combustion engine with a dry-sump lubrication.

Because of the horizontally arranged cylinders, the annular spaces used for the lubricating oil return can be vented in the upward direction. This achieves a defoaming of the lubricating oil, and the above-described oil/air separator may not be necessary.

Other objects, advantages and novel features of the present invention will become apparent from the following detailed description of the invention when considered in conjunction with the accompanying drawings.

DETAILED DESCRIPTION OF THE DRAWINGS

Figure 1:
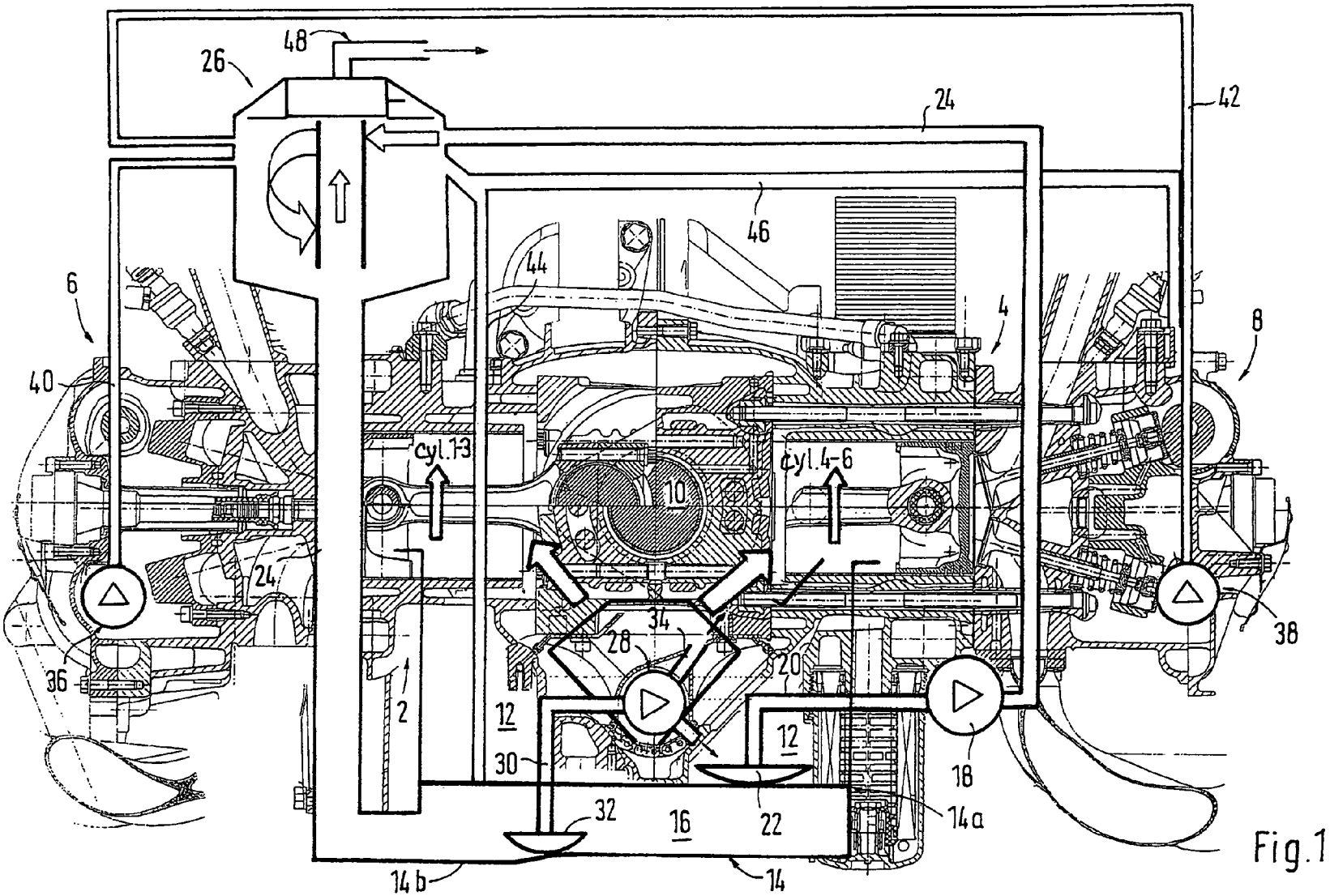
FIG. 1 is a schematic view of a dry-sump oil circulation system of an internal-combustion engine according to a first embodiment of the present invention.

FIG. 1 illustrates the principle of a dry-sump oil circulation diagram, which is not limited to this embodiment, for a 6-cylinder horizontally opposed engine, whose components, required only for describing the oil circulation, will be described. The engine has two crankcase halves 2, 4 in which one cylinder bank row 1 to 3 and 4 to 6, respectively is arranged. The two cylinder bank rows are adjoined by one cylinder head 6, 8 respectively, in which is arranged the valve operating mechanism for operating the intake and exhaust valves. Below the bearing for the crankshaft 10, the crankcase 2, 4 has a (dry-sump) oil scavenging space 12 in which is collected the lubricating oil for lubricating the main bearings. Oil return holes (not shown) integrated in the engine ensure that the lubricating oil is returned into the oil scavenging space 12 in a targeted manner. An oil lid 14, which closes off the oil scavenging space 12 in the downward direction, has a double-walled construction, and the hollow space 16 formed in the oil lid 14 is the (wet-sump) oil storage space.

For the dry-sump pressure lubrication system, an oil return pump 18 is provided to whose suction side an oil scavenging pipe 20 is connected which leads to the oil scavenging space 12. An oil scavenging snorkel 22 is fastened to the end of the oil scavenging pipe 20 and comes to rest on the upper oil lid wall 14*a*. A pipe 24 is connected to the delivery side of the oil return pump 18 and leads to the oil storage space 16 by way of an oil/air separator 26 constructed, for example, as a so-called swirl pot.

By way of an intermediate shaft (not shown in detail), a main feed pump 28 is driven, to whose suction side an oil scavenging pipe 30 is connected which leads into the oil storage space 16 via an opening in the upper oil lid wall 14*a*. An oil scavenging snorkel 32 is again fastened to the end of the oil scavenging pipe 30 and is placed in the proximity of the lower oil lid wall 14*b*. By way of the delivery side 34 of the main feed pump 28, oil feeding pipes (not shown in detail) integrated in the crankcase 2, 4 lead to the consuming devices, such as the main bearing points of the crankshaft and of the camshaft. Scavenging pumps 36,38 driven by the camshafts are provided in the two cylinder heads 6, 8 of the internal-combustion engine. The scavenging pumps 36, 38, by way of suction, remove the lubricating oil fed by the main feed pump 28 into the cylinder heads and return the oil by way of the pipes 40, 42 and the oil/air separator 26 also into the oil storage space 16. For venting the oil storage space 16 and the crankcase 2, 4, vent pipes 44, 46 are also connected to the oil/air separator 26. For removing the separated air or the blow-by gases, the oil/air separator 26 is connected via a pipe 48 with the suction system of the internal-combustion engine. The dry-sump pressure lubrication takes place by the lubricating oil situated in the oil scavenging space 12 being removed by suction by way of the oil return feed pump 18 and fed into the oil storage space 16. From there, the lubricating oil is fed to the consuming devices via the main feed pump 28.

Figure 2:
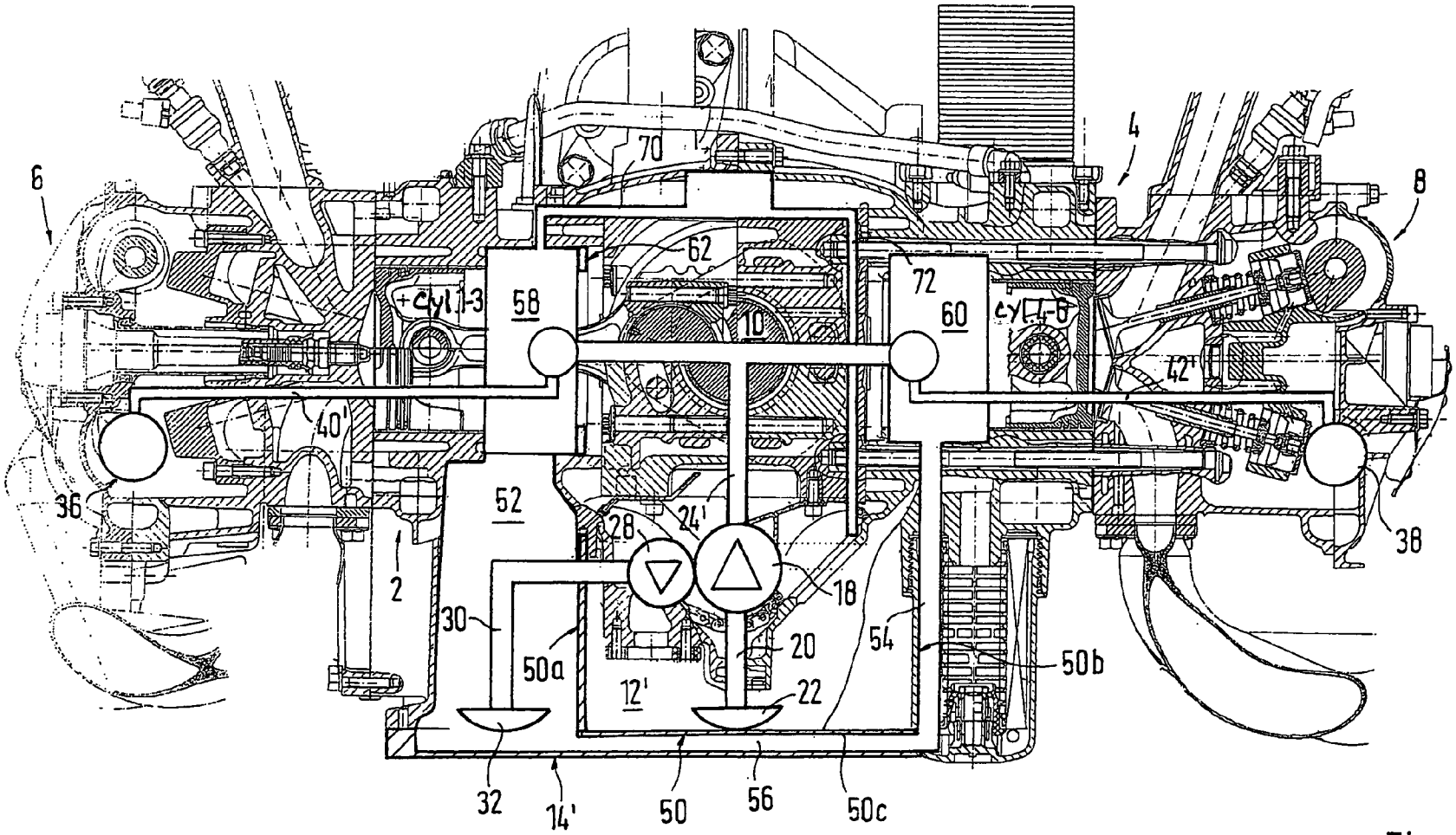
FIG. 2 is a schematic view of a dry-sump oil circulation system of an internal-combustion engine according to a second embodiment.
Figure 3:
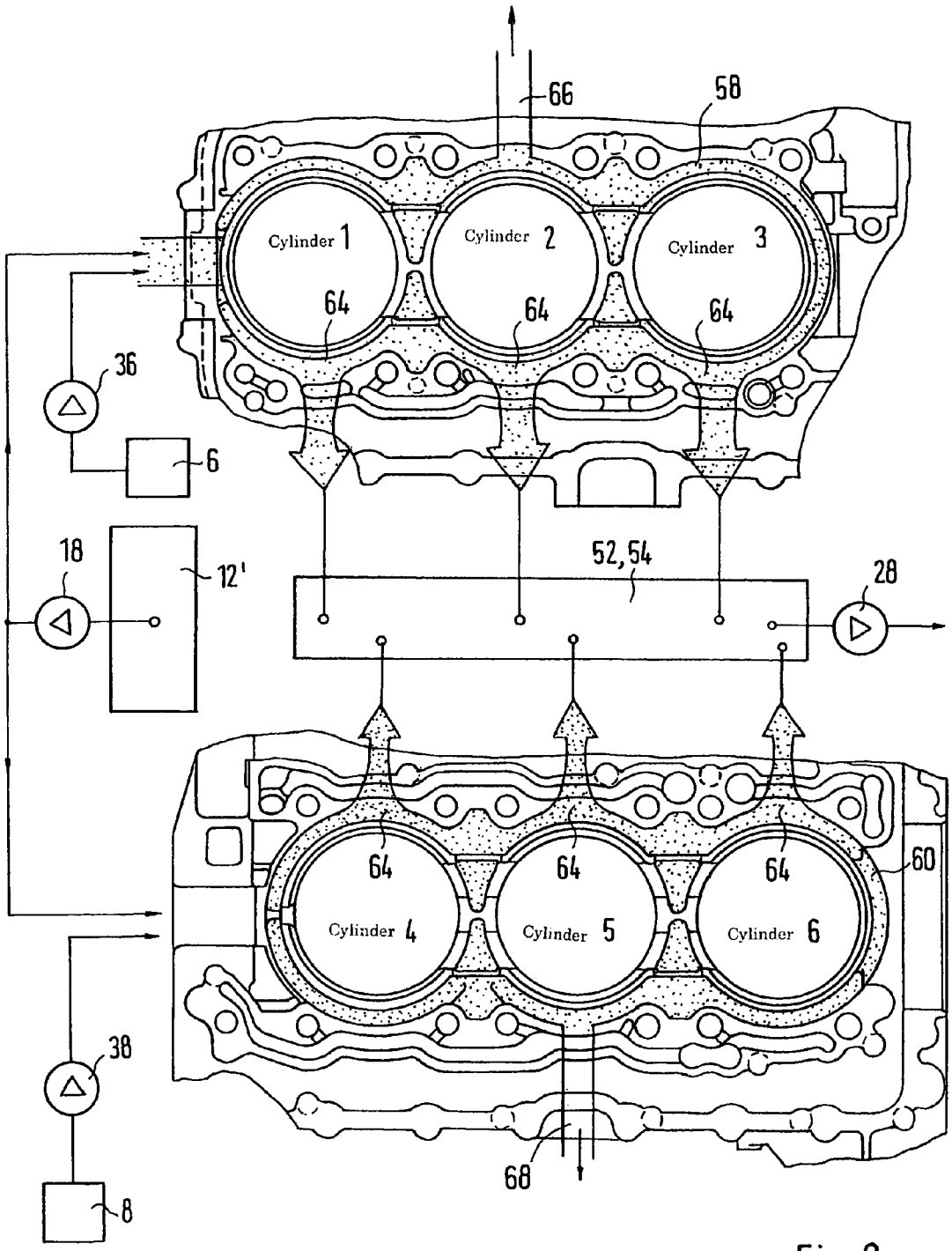
FIG. 3 is a basic diagram of the oil return in the area of the cylinders according to the second embodiment.

In the second embodiment according to FIG. 2, in which identical components have the same reference numbers, the dry-sump oil scavenging space 12' is bounded by an oil partition box 50 whose two side walls 50*a*, 50*b* are adjoined by (wet-sump) collecting spaces 52, 54. The two collecting spaces 52, 54 are connected with one another by a space between the lower wall of the oil partition box 50*c* and an oil pan lid 14'. In contrast to the first embodiment, the lubricating oil fed from the oil scavenging space 12' into the (wet-sump) collecting spaces 52, 54 is guided by one annular space 58, 60 respectively surrounding the cylinders 1 to 3 as well as 4 to 6, which are sealed off on their face side facing the crankspace by a seal 62 (shown only in the left crankcase half 2), for example, in the form of a plastic gland. As illustrated in FIGS. 2 and 3, the annular spaces 58, 60 have openings or holes 64 at their lower lateral surface areas. The openings or holes 64 are each connected with the (wet-sump) collecting spaces 52, 54. The center cylinder of the two cylinder bank rows 1 to 3 and 4 to 6, respectively, has a venting connection piece 66, 68 which is connected on the upper—relative to the installation position of the cylinders—side of the annular spaces 58, 6 respectively.

As also shown in FIGS. 2 and 3, the lubricating oil removed by suction by the scavenging pumps 36, 68 from the cylinder heads 6, 8 is also fed via the annular spaces 58, 60 into the collecting spaces 52, 54. Because of this method of oil return, externally laid oil pipes can largely be eliminated. By way of the annular spaces 58, 60, the lubricating oil can be defoamed, and air and gas fractions can be removed to the outside by the venting connection pieces 66, 68, so that separate oil/air separators will not be necessary. As illustrated in FIG. 2, the wet-sump collecting spaces 52, 54 and the dry-sump oil scavenging space 12' are vented by corresponding pipes 70 and 72.

Of course, the last-described implementation of the integrated oil return via the annular spaces 58, 60 can also be used in the dry-sump implementation described according to FIG. 1.

Figure 4:
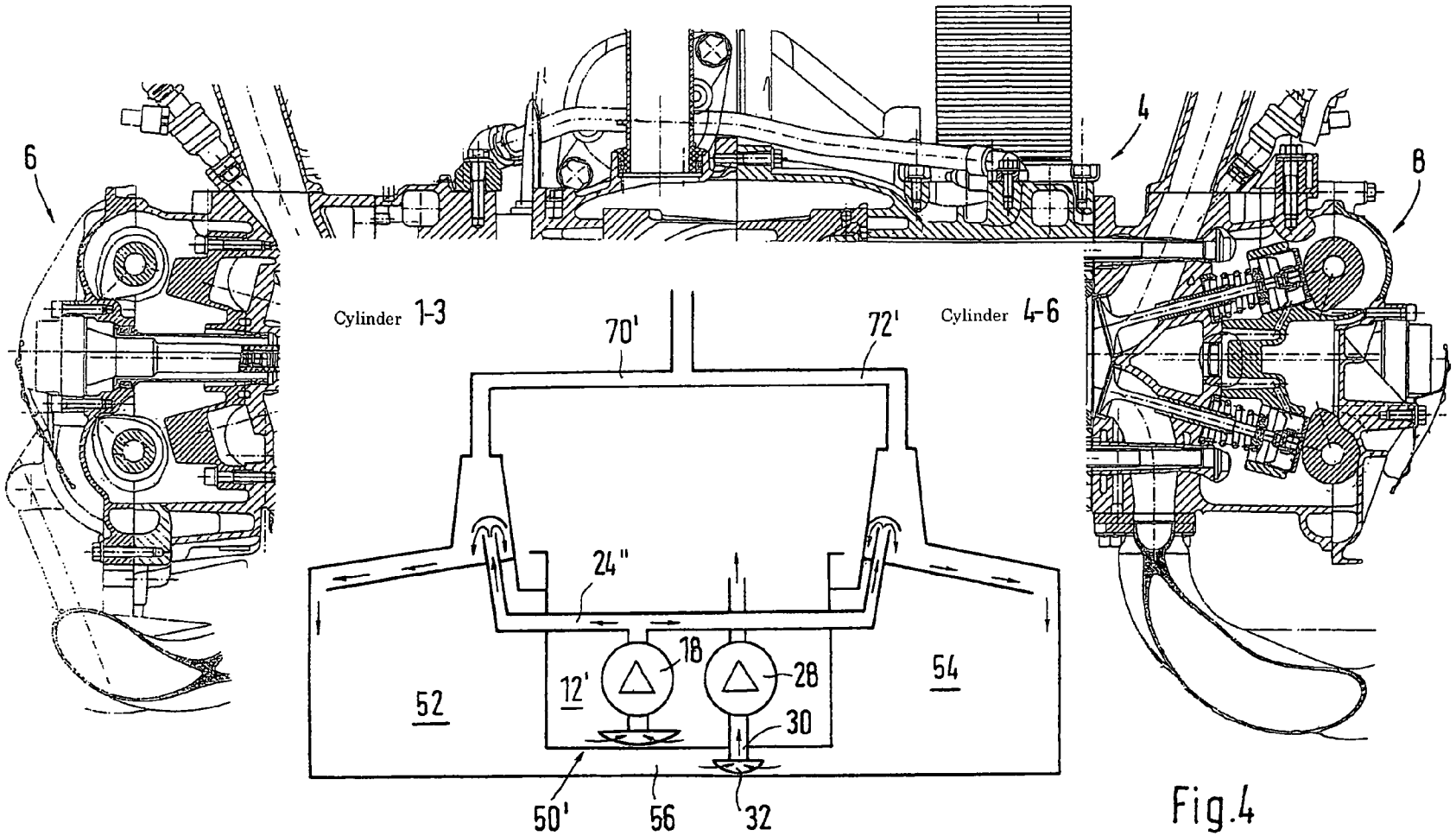
FIG. 4 is a schematic view of a dry-sump oil circulation system of an internal-combustion engine according to a third embodiment.

The third embodiment illustrated in FIG. 4 differs from the second embodiment (see FIG. 2) in that the oil partition box 50' is arranged essentially in the center in the (wet-sump) oil storage space. The wet-sump collecting spaces 52, 54, which are therefore symmetrically constructed and mutually connected by the space 56 ensures that, despite lateral accelerations in both directions, sufficient lubricating oil for the main feed pump 28 is present in the space 56.

A connection, for example, in the form of holes, pipes or the like, exists between the (wet-sump) oil storage space and the dry-sump oil scavenging space 12', so that a vacuum can occur also in the (wet-sump) oil storage space for venting the blow-by gases. For limiting the pressure, a pressure control valve may be arranged in the connection.

The invention claimed is:

1. A horizontally-opposed cylinder internal-combustion engine having a pressure lubrication system according to the dry-sump principle, comprising a crankcase in which an oil scavenging space forming a dry sump is constructed in the lower part from which the lubricating oil is fed by way of an oil return feed pump equipped with an oil scavenging pipe to an oil storage space forming a wet sump, and a main feed pump feeds the lubricating oil situated in the oil storage space to consuming devices, wherein the oil storage space forming a wet sump is integrated in the internal-combustion engine crankcase, wherein the oil return feed pump feeds scavenged oil to an oil return comprising annular spaces around the cylinders, the annular spaces having openings in a lower lateral surface thereof connecting to the oil storage space forming a wet sump.

2. Internal-combustion engine according to claim 1, wherein the oil storage space is below the oil scavenging space.

3. Internal-combustion engine according to claim 2, wherein an oil lid closing off the oil scavenging space in a downward direction has a double-walled construction, and a hollow space forms the oil storage space.

4. Internal-combustion engine according to claim 1, wherein the oil storage space is integrated in the crankcase so as to be separated from the oil scavenger space by at least one partition wall.

5. Internal-combustion engine according to claim 4, wherein an oil partition box is arranged substantially centrally in the oil storage space.

6. Internal-combustion engine according to claim 1, wherein the lubricating oil removed by suction from the oil scavenging space and the cylinder heads is guided by an oil/air separator before arriving in the oil storage space.

7. Internal-combustion engine according to claim 1, wherein the annular spaces are vented in an upward direction.

* * * * *